United States Patent [19]

Jarman et al.

[11] Patent Number: 4,712,417

[45] Date of Patent: Dec. 15, 1987

[54] SWIVEL PULL TOWER

[75] Inventors: Davis R. Jarman, Hortense; Virgil H. Hinson, Brunswick, both of Ga.

[73] Assignee: Grabber Manufacturing Company, Brunswick, Ga.

[21] Appl. No.: 834,564

[22] Filed: Feb. 28, 1986

[51] Int. Cl.[4] ..... B21D 1/12

[52] U.S. Cl. ..... 72/447; 72/705

[58] Field of Search ..... 72/705, 447; 254/257

[56] References Cited

U.S. PATENT DOCUMENTS

| | | | |
|---|---|---|---|
| 1,537,070 | 5/1925 | Dixon | 254/257 |
| 3,398,565 | 8/1968 | Whitney | 72/705 |
| 3,583,203 | 6/1971 | Williams et al. | 72/705 |
| 4,201,076 | 5/1980 | Jarman et al. | 72/705 |
| 4,507,951 | 4/1985 | Hultquist | 72/705 |

FOREIGN PATENT DOCUMENTS

| | | | |
|---|---|---|---|
| 1373287 | 11/1974 | United Kingdom | 72/705 |

*Primary Examiner*—Lowell A. Larson

*Attorney, Agent, or Firm*—Fleit, Jacobson, Cohn & Price

[57] ABSTRACT

An elongated horizontal base is provided including inner and outer ends and a depending foot assembly is carried by the outer end and supported therefrom for angular displacement relative to the base about an upstanding axis. The foot assembly is adapted for anchoring in a stationary position relative to a floor area above which a vehicle having a body, subframe or frame portion to be straightened may be stationarily positioned and an upright projects upwardly from the base outer end and has a horizontally elongated pull arm pivotally supported therefrom for angular displacement about a horizontal axis extending transversely of the upright, base and pull arm. The axis is centrally spaced between the opposite ends of the pull arm and the latter is mounted for guided longitudinal shifting relative to the axis. The forced structure is operatively connected between the pull arm and the upright for longitudinally shifting the pull arm in a direction displacing the inner end toward the upright and the inner end includes chain section link anchoring means.

9 Claims, 6 Drawing Figures

SWIVEL PULL TOWER

BACKGROUND OF THE INVENTION

1. Field of the Invention

This invention relates to a tower structure movable along and to be anchored relative to a floor track extending along one marginal portion of an area in which a vehicle is anchored having a frame, subframe or body portion to be straightened. The tower structure supports a hydraulically actuated pull arm therefrom for oscillation about an axis extending transversely of the pull arm and the tower and adjustably positionable along the latter and the tower structure includes a foot portion releasably engaged with the floor track and relative to which the tower structure may be angularly displaced about an upstanding axis. Tower structures including the general structural and operational features of the instant invention are classified in class 254, subclass 228.

2. Description of Related Art

Various different forms of pull towers including some of the general structural and operational features of the instant invention are disclosed in U.S. Pat. Nos. 3,492,855, 3,698,230, 3,796,084, 4,309,895, 4,475,716, 4,507,951 and British Patent No. 1,373,287.

However, these previously known forms of pull tower structures do not include all of the structural and operational features of the instant invention wherein the pull tower may be positioned longitudinally along a floor mounted track, anchored relative to the track against sliding movement therealong, angled with respect to a plane normal to the track and utilized to apply a horizontal or inclined pull between the tower structure and an associated vehicle frame, subframe or body component.

SUMMARY OF THE INVENTION

The swivel pull tower of the instant invention includes a base and an upright post extending upwardly from the base. The base includes foot structure for engagement with one longitudinal marginal edge of a track flange anchored relative to a vehicle repair area floor by bolts spaced along the flange, extending downwardly therethrough and anchored relative to the floor. The foot structure is mounted from the base of the tower for angular displacement about an upstanding axis relative to the tower and includes structure for engaging the track flange anchoring bolts in a manner to prevent sliding movement of the foot along the track flange. The upright includes a generally horizontal pull arm supported therefrom for angular displacement about a horizontal axis extending transversely of the pull arm and the upright and vertically adjustable along the latter. A hydraulic ram is operatively connected between the pull arm and the upright for shifting the pull arm longitudinally relative to the upright and one end of the pull arm includes first anchor structure selectively releasably engagable with links of an associated pull chain. In addition, the upright includes second anchor structure selectively releasably engageable with links of the associated pull chain.

The main object of this invention is to provide a pull tower for use in straightening vehicle body portions, subframe portions and frame portions with the lower end of the tower anchorable to selected longitudinally spaced portions of a floor mounted track flange.

Another object of this invention is to provide a pull tower having a foot portion releasably engageable with a corresponding track flange and relative to which the tower may be angularly displaced about a vertical axis.

A further object of this invention is to provide a pull tower in accordance with the preceding objects wherein the foot portion of the pull tower includes structure thereon abutingly engageable with anchor bolts spaced along and utilized to anchor the flange of the associated track to a floor area, whereby to prevent sliding movement of the foot portion along the track during a pull exerted by the tower at an angle relative to a plane normal to the track.

Yet another object of this invention is to provide a pull tower having a pull arm supported therefrom for longitudinal shifting transversely of the tower and with one end of the pull arm including anchor structure for selectively releasably anchoring a pull chain link to the arm.

Another object of this invention is to provide a pull tower and pull arm assembly in accordance with the preceding objects and wherein second anchor structure is provided for releasably anchoring a selected pull chain link relative to the tower.

A final object of this invention to be specifically enumerated herein is to provide a height adjustable pull tower in accordance with the preceding objects and which will conform to conventional forms of manufacture, be of simple construction and easy to use so as to provide a device that will be economically feasible, longlasting and relatively troublefree in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
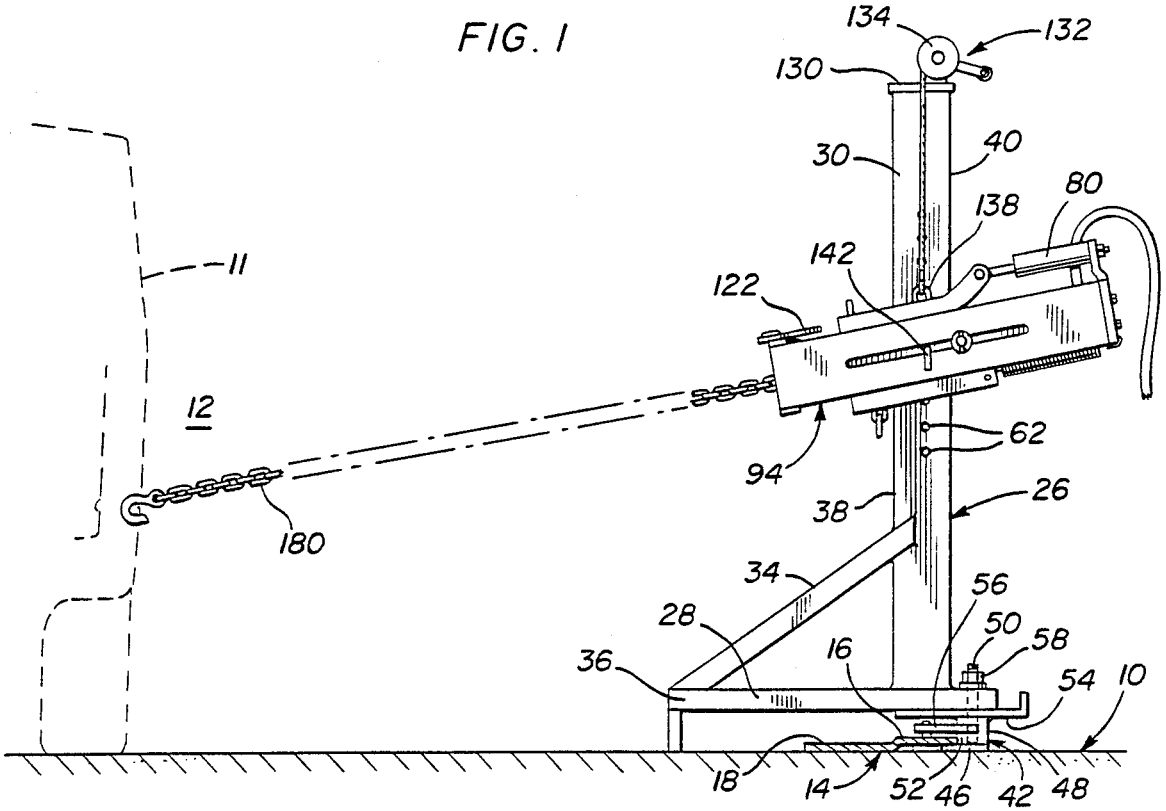
FIG. 1 is a side elevational view of a typical installation of the pull tower of the instant invention.
Figure 2:
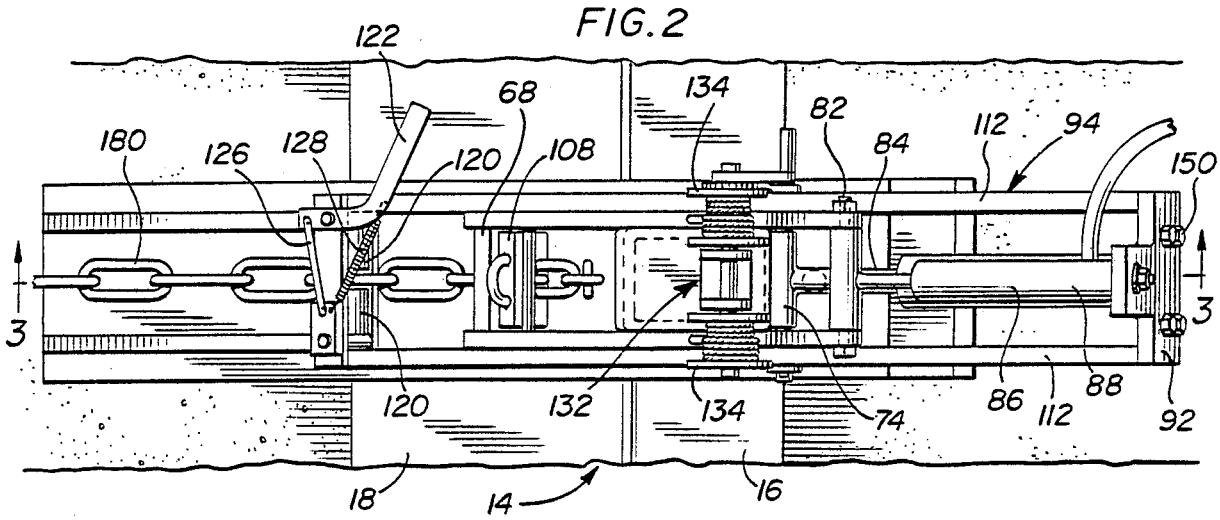
FIG. 2 is a top plan view of the assemblage shown in FIG. 1.
Figure 4:
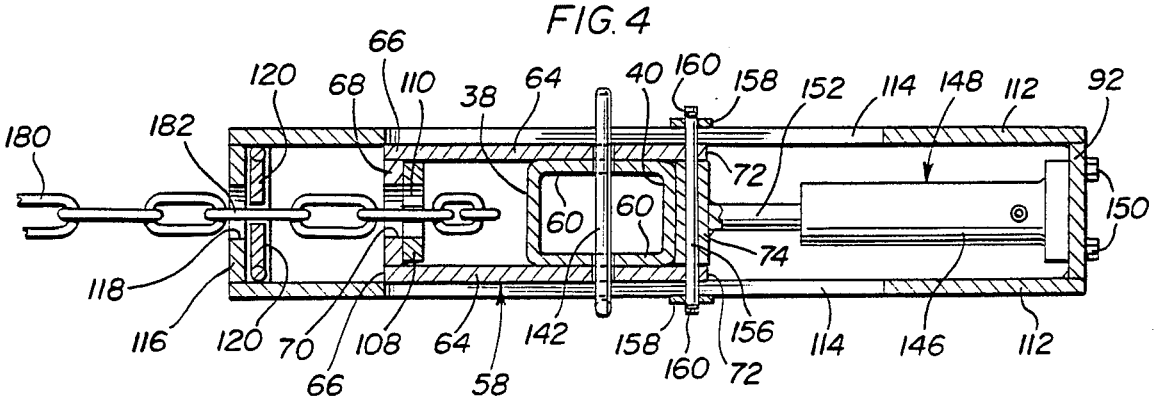
FIG. 4 is a horizontal sectional view taken substantially upon the plane designated by the section line 4—4 of FIG. 3.
Figures 3, 5, 6:
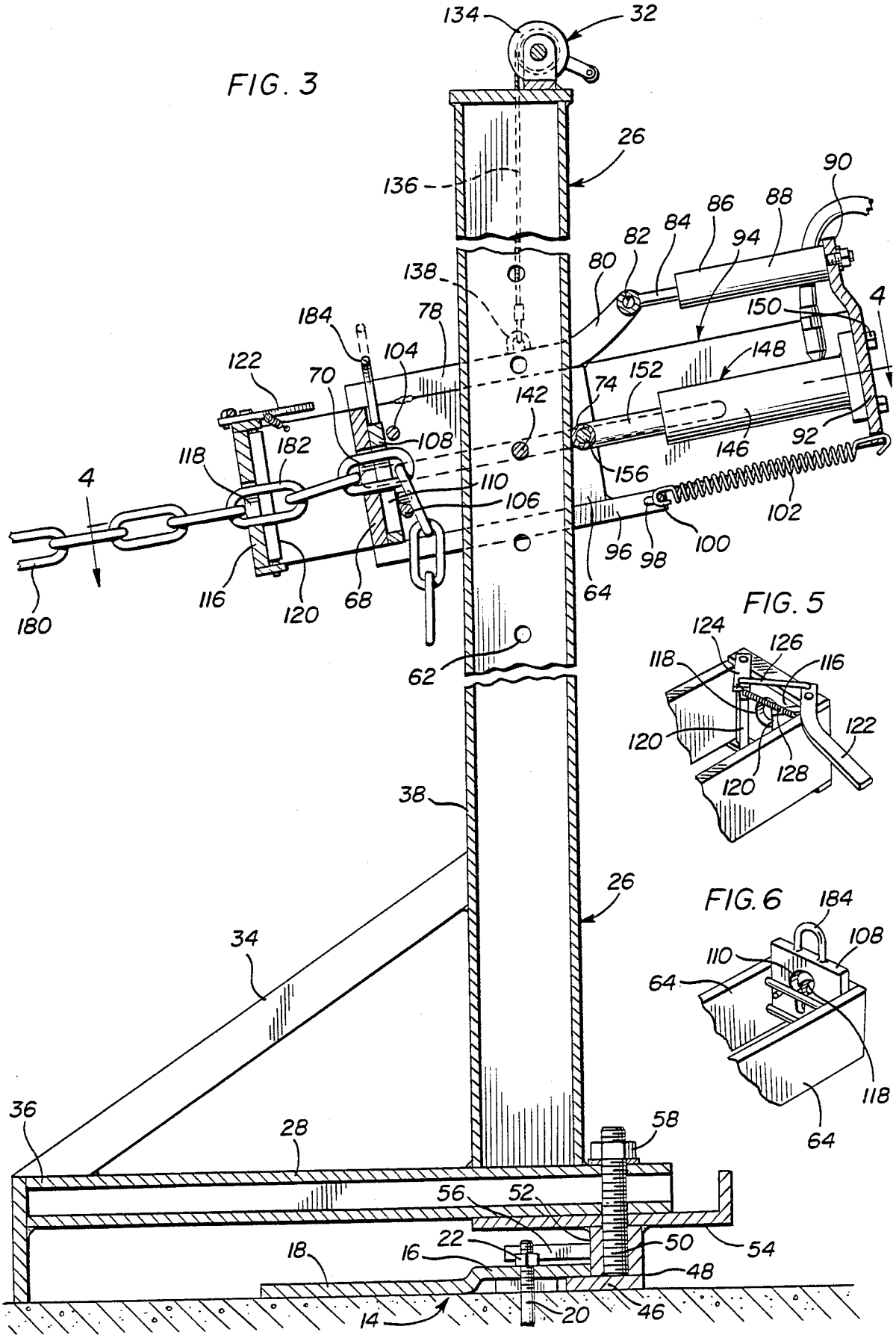
FIG. 3 is a vertical sectional view taken substantially upon the plane designated by the section line 3—3 of FIG. 2.
FIG. 5 is a perspective view of the first chain link anchor structure.
FIG. 6 is a perspective view of the second chain link anchor structure.

Referring now more specifically to the drawings the numeral 10 generally designates a typical repair shop floor defining an area 12 thereover in which a vehicle 11 may be stationarily anchored and a track 14 extends along one marginal portion of the area 12 and includes vertically offset upper and lower flanges 16 and 18 defining opposite side longitudinal marginal portions of the track 14. The flange 18 is downwardly abutted against the floor 10 and longitudinally spaced portions of the flange 16 are anchored relative to the floor 10 through the utilization of upstanding threaded studs 20 having their lower ends anchored relative to the floor 10 and their upper ends secured through openings provided therefor in the flange 16 by the utilization of nuts 22. The studs 20 and the corresponding openings in the flange 16 are spaced apart longitudinally of the latter approximately 12 inches. In addition, upstanding flange members 24 are disposed lengthwise transversely of the flange 16 beneath the latter on opposite sides of each stud 20 and provide backing for the flange 16 on opposite sides of each nut 22.

The swivel pull tower of the instant invention is referred to in general by the reference numeral 26 and includes a horizontally elongated base member 28 and a tubular upright 30 having its lower end anchored relative to a first end portion 32 of the base member 28. The upright 30 is braced relative to the base member 28 through the utilization of an inclined brace 34 extending and secured between the second end portion 36 of the base member 28 and the front or inner side 38 of the upright 30. The first end portion 32 of the base member 28 projects outwardly beyond the rear side 40 of the upright 30 and has a vertical bore 41 formed therethrough. The tower 26 includes a foot assembly referred to in general by the reference numeral 42 and the foot assembly includes an angle member 44 including a horizontal flange 46 and a vertical flange 48. The foot assembly 42 additionally includes an upstanding threaded shank 50 laterally abutted against and secured to the vertical flange 48 centrally intermediate the opposite ends of the angle member 44 and the shank lower end is secured to the horizontal flange 46 and a pair of upstanding plates 52 paralleling the vertical flange 48 have their lower ends anchored relative to the horizontal flange 46 and spaced apart opposing edges abutted against and secured to the side of the shank 50 remote from the vertical flange 48, the plates 52 being spaced apart and extending longitudinally of the angle member 44.

A bearing plate 54 has an opening formed therethrough upwardly through which the shank 50 is received and the upper edges of the plates 52 and the vertical flange 48 are coextensive and abutted by and secured to the underside of the bearing plate 54.

The approximate mid-height portions of the plates 52 include horizontally outwardly projecting abutment plates 56 supported therefrom and spaced longitudinally apart along the angle member 44. The upper end of the shank 50 is rotatably received through the bore 41 in the first end portion 32 of the base member 28 and secured therethrough by a threaded nut 58. The underside of the base member 28 bears against the upper surface of the bearing plate 54 and the base member 28 may pivot relative to the foot assembly including the bearing plate 54 about the center axis of the shank 50.

The horizontal flange 46 of the foot assembly 42 may be hooked beneath the free longitudinal edge of the flange 16 with the abutment plates 56 disposed above the flange 16 and embracingly receiving a selected nut 40 therebetween. The foot assembly 42 extends along the flange 16 approximately 6 inches and the studs 20 are spaced apart at approximately one foot intervals along the track 14. Thus, the foot assembly 42 also may be disposed between adjacent studs 20 with the side of one abutment flange 56 remote from the other abutment flange 56 abutted against a nut 22.

The opposite side plates 60 of the upright 30 have registered vertically spaced bores 62 formed therethrough and an elongated guide 58 is provided and incorporates a pair of short opposite side plates 64 disposed on opposite sides of the upright 30 and including one set of corresponding ends 66 interconnected by a transverse connecting plate 68 extending and secured therebetween and having a central circular opening 70 formed therethrough. The other set of corresponding ends 72 of the plates 64 have a short length of pipe 74 loosely extending therebetween and one side of the pipe 74 includes a lateral projection 76 centrally intermediate the opposite ends of the pipe 74 for a purpose to be hereinafter more fully set forth. The upper marginal edges of the plates 64 include opposite side bars 78 secured thereto and extending therealong and the rear or outer ends 80 of the bars 78 curve upwardly and have a transverse pin 82 extending and secured therebetween. The free end of the extendable piston portion 84 of a shock absorber 86 is anchored relative to the longitudinal center of the pin 82 and the cylinder portion 88 of the shock absorber 86 is anchored relative to an upper extension 90 of a rear Plate 92 comprising the rear extremity of a pull arm assembly referred to in general by the reference numeral 94. The lower marginal edges of the plates 64 include opposite side bars 96 secured thereto and extending therealong and the rear or outer ends of the bars 96 project rearward of the plates 64 and have a transverse pin 98 extending and secured therebetween including a laterally offset midportion 100 to which one end of a coiled expansion spring 102 is anchored, the other end of the expansion spring 102 being anchored relative to the central portion of the lower marginal edge of the rear plate 92.

The forward or inner end portions of the plates 64 include a pair of upper and lower pins 104 and 106 extending and secured therebetween and an anchor plate 108 is vertically slidable between the plate 68 and the upper and lower pins 104 and 106. The anchor plate 108 includes a keyhole-shaped opening 110 formed therein and an abutment tab 111 abuttingly engageable with the pins 104 and 106 to limit upward and downward shifting of the plate 108.

The pull arm assembly 94 includes a pair of opposite side plates 112 having longitudinal slots 114 formed therein and the rear ends of the plates 112 are interconnected by the rear plate 92. The forward ends of the plates 112 are interconnected by a front plate 116 having a central cylindrical opening 118 formed therein and a pair of opposite side anchor Plates 120 are pivotally supported from the front end of the pull arm assembly 94 immediately inward of the front plate 116. The anchor plates 120 are swingable to closed positions tightly abutted against the inner side of the front plate 16 with the free marginal edges of the anchor plates 120 closely spaced apart to define a narrow slot therebetween and open positions with the free swinging edges of the plates 120 swung inwardly away from the front plate 116 to define a wider slot therebetween. An actuating lever 122 is carried by one of the plates 120 and is operatively connected to a crank arm 124 carried by the other plate 120 through the utilization of a connecting link 126. In addition, an expansion spring 128 is operatively connected between the crank arm 124 and the distant side plate of the pull arm assembly 94, whereby the plates 120 are yieldingly biased toward their closed positions defining a narrow slot therebetween.

The upper end of the upright 30 is closed by a top plate 130 supporting a winch assembly 132 thereabove. The winch assembly 132 includes axially spaced winding drums 134 on opposite sides of the upright 30 and each of the winding drums 134 has one end of a cable 136 secured thereto for winding thereon and the other ends of the cables 136 are anchored relative to anchor members 138 carried by the longitudinal midportions of the bars 78.

The plates 64 include central openings 140 formed therethrough registered with the slots 114 and registrable with a corresponding pair of bores 62. A latch and pivot pin 142 is insertable through the slots 114, the openings 140 and a selected pair of bores 62 in order to maintain the pull arm assembly 94 in adjusted position vertically along the upright 30.

The cylinder portion 146 of a hydraulic ram referred to in general by the reference numeral 148 has its base end anchored relative to the rear plate 92 through the utilization of fasteners 150 and the ram 148 includes an extendable piston portion 152 whose free end includes an endwise outwardly opening recess 154 in which the projection 76 is secured. A pin 156 extends through the pipe 74, corresponding openings 140 provided therefor in the plates 64 and also through the slots 114. The opposite ends of the pin 156 are secured through the slots 114 by washers 158 and cotter pins 160.

In operation, the foot assembly 42 of the swivel pull tower 26 is engaged with a selected longitudinally spaced portion of the flange 16 of the track 14 with the abutment plates 56 embracingly engaging a selected nut 22 therebetween. Inasmuch as the foot assembly 42, during operation of the tower 26, will be pulled into tight seated engagement with the outer longitudinal edge of the flange 16 and the plates 56 are disposed on opposite sides of a corresponding nut 22, the foot assembly 42 will be prevented from shifting longitudinally of the track 14. The upright 30 and base member 28 may then be angularly displaced as desired in order to effect a pull on a vehicle portion disposed in the area 12 with the direction of pull inclined relative to a vertical plane disposed normal to the track 14. The free end of a chain section 180 may be anchored relative to the vehicle portion upon which a pull is to be exerted and the other end of the chain section 180 may have a vertically disposed link 182 thereof passing through the opening 118 and snugly received through the narrow slot defined between the adjacent edges of the plates 120 when the latter are in their closed positions. Then, the hydraulic ram 148 may be actuated to extend the piston portion 152 and the pipe 74 will exert a push on the rear or outer side 40 of the upright 30. This will cause rearward movement of the pull arm assembly 94 and exert a pull on the chain section 180. When the ram 148 has been fully extended, the end of the chain section 180 adjacent the upright 30 may be pulled through the wider upper portion of the keyhole-shaped opening 110 formed in the plate 108. Then, with an upward pull exerted on the bale 184 carried by the plate 108 the hydraulic pressure on the ram 148 may be slowly released until the abutment plates 120 close and the plate 108 may be upwardly shifted to engage the narrow portion of the keyhole-shaped opening 110 about a vertically disposed link 182 of the chain section 180. Thereafter, further release of hydraulic pressure to the ram 148 will allow the expansion spring 102 to collapse the ram 148 and the pull arm assembly 94 may move in a forward direction along the tensioned chain section and the plates 120 will automatically be swung to the open position to allow the pull arm assembly 94 to move along the tensioned chain section. When the ram 148 is fully retracted, it may again be actuated toward an extended position and the plates 120 will subsequently swing to the closed positions, automatically, and engage a horizontal link 182 of the chain section 180 and exert a further pull on the chain section 180. At this time, that portion of the chain anchored relative to the plate 108 will become slack and the plate 108 will automatically slide, by gravity, to the lower position thereby enabling the end of the chain section 108 to slide through the circular opening 70 and the wider upper circular opening portion of the opening 110 formed in the plate 108. This process may be repeated until the desired pull on the associated vehicle portion is accomplished.

During extension of the hydraulic ram 148 the pipe 74 bears against the rear or outer side 40 of the upright 30 in order to longitudinally shift the pull arm assembly 94 in a rearward direction relative to the upright 30.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a floor anchored elongated track including inner and outer longitudinal marginal portions and wherein said outer marginal portion is spaced above an associated floor, a pull tower assembly including a horizontally elongated base having inner and outer ends and an upright anchored relative to and projecting upwardly from said outer end, a foot assembly mounted beneath said outer end for angular displacement relative thereto about an upstanding axis and embracingly engaging said outer longitudinal marginal portion for adjusted shifting therealong, said inner end of said base projecting inwardly of said inner longitudinal marginal portion and including downwardly facing abutment means for abutting said floor inwardly of said track, a horizontally elongated guide having inner and outer ends and opposite side plates between which said upright is slidingly received, a horizontally elongated pull arm including opposite side plates between which said guide is slidably received and also having inner and outer ends, corresponding to the first and second mentioned inner and outer ends, pivot means pivotally mounting an intermediate length portion of said guide from said upright for oscillation relative thereto about a horizontal axis extending transversely of said upright, base and pull arm and slidingly guidingly supporting said pull arm from said guide for longitudinal shifting relative thereto, force means operatively connected between said pull arm and upright for longitudinally shifting said pull arm relative to said pivot means and guide in a direction to shift said inner end of said pull arm toward said upright, first link chain section link anchoring means carried by said inner end of said pull arm for releasably anchoring a link chain section link relative to said pull arm and second link chain section link anchoring means anchored relative to said guide outwardly of said inner end of said pull arm and inwardly of said upright and to which a link chain section link may be anchored.

2. The track and pull tower combination of claim 1 wherein said force means is operatively connected between said outer end of said pull arm and said upright.

3. The combination of claim 2 wherein said force means comprises a hydraulic ram.

4. The track and pull tower combination of claim 1 including shock absorber means operatively connected between said pull arm and upright for velocity governing longitudinal shifting of said pull arm relative to said upright in a direction displacing said inner end of said pull arm away from said upright.

5. The combination of claim 4 including means operatively connected between said pull arm and upright yieldingly biasing lengthwise shifting of said pull arm relative to said upright in a direction shifting said outer end of said pull arm toward said upright.

6. A pull tower assembly including a horizontally elongated base having inner and outer ends and means carried by said outer end adapted for anchoring said outer end relative to a floor surface for angular displacement about an upstanding axis, an upright anchored relative to and projecting upwardly from said outer end inwardly of said axis, said inner end of said base including downwardly facing abutment means for abutting said floor, a horizontally elongated guide having inner and outer ends and opposite side plates between which said upright is slidably received, a horizontal elongated pull arm including opposite side plates between guide is slidably received and also having inner nad outer ends corresponding to the first and second mentioned inner and outer ends, pivot means pivotally mounting an intermediate length portion of said guide arm from said upright for oscillation relative thereto about a horizontal axis extending transversely of said upright, base and pull arm and slidingly guidingly supporting said pull arm from said guide for longitudinal shifting relative thereto, force means operatively connected between said pull arm and upright for longitudinally shifting said pull arm relative to said pivot means and guide in a direction to shift said inner end of said pull arm toward said upright, first link chain section link anchoring means carried by said inner end of said pull arm for releasably anchoring a link chain section link relative to said pull arm and second link chain section link anchoring means anchored relative to said guide outwardly of said inner end of said pull arm and inwardly of said upright and to which a link chain section link may be releasably anchored.

7. The pull tower assembly of claim 6 wherein said force means is operatively connected between said outer end of said pull arm and said upright.

8. The pull tower assembly of claim 7 wherein said force means comprises a hydraulic ram.

9. The pull tower assembly of claim 8 including shock absorber means operatively connected between said pull arm and upright for velocity governing longitudinal shifting of said pull arm relative to said upright in a direction displacing said outer end of said pull arm toward said upright.

* * * * *